US005850919A

United States Patent [19]

Freed

[11] Patent Number: 5,850,919

[45] Date of Patent: Dec. 22, 1998

[54] COMPLIANCE CLOSURE

[76] Inventor: Anna B. Freed, 185 E. 85th St., New York, N.Y. 10028

[21] Appl. No.: 873,074

[22] Filed: Jun. 11, 1997

[51] Int. Cl.[6] ..... B65D 85/58

[52] U.S. Cl. ..... 206/534; 206/538; 215/6

[58] Field of Search ..... 206/459.5, 528, 206/533, 534–536, 538–540; 215/6

[56] References Cited

U.S. PATENT DOCUMENTS

| | | | |
|---|---|---|---|
| 2,335,016 | 11/1943 | Lorenzen et al. | 206/538 |
| 2,433,663 | 12/1947 | Hanson | 206/459.5 |
| 2,706,464 | 4/1955 | North | 206/459.5 |
| 3,027,000 | 3/1962 | Kantrow | 206/536 |
| 3,033,409 | 5/1962 | Lind | 206/540 |
| 3,367,484 | 2/1968 | Nelson | 206/538 |
| 3,425,578 | 2/1969 | Owens | 206/536 |
| 3,433,378 | 3/1969 | Ross | 215/6 |
| 3,477,561 | 11/1969 | Espinal | 206/536 |
| 3,889,847 | 6/1975 | Uroshevich et al. | 206/540 |
| 4,151,910 | 5/1979 | Yasur | 206/540 |
| 4,261,468 | 4/1981 | Krebs . | |
| 4,288,006 | 9/1981 | Clover, Jr. . | |
| 4,381,059 | 4/1983 | Schurman | 206/533 |
| 4,420,076 | 12/1983 | Beveridge et al. . | |
| 4,420,083 | 12/1983 | Baustin . | |
| 4,475,654 | 10/1984 | Fruchter . | |
| 4,613,057 | 9/1986 | Sacchetti et al. . | |
| 4,616,752 | 10/1986 | Ridgley . | |
| 4,805,789 | 2/1989 | Lancesseur et al. | 206/540 |

*Primary Examiner*—Jim Foster
*Attorney, Agent, or Firm*—Darby & Darby

[57] ABSTRACT

An indicating closure having compartments for different medications that are part of a medication regimen. The compartments are created using removable dividers and/or covers which cooperate with an indicating closure to help the user comply with her medication regimen (i.e., compliance). Thus, a user has access to the correct drug and/or dose when she opens the closure at the indicated time.

21 Claims, 2 Drawing Sheets

10
12
16
18
20
21
22
24
26
28
30
32
34
MORN NOON EVE

COMPLIANCE CLOSURE

BACKGROUND OF THE INVENTION

1. Field of the Invention

The present invention relates to compliance closures. More specifically, the present invention relates to compliance closures that help users take their medication properly (for complex medication regimens requiring periodic changes to drug and dose). The present invention insures that only the correct drug and/or dose is accessible to the user each time she opens the closure.

Typical changes in drug and/or dose include:

Change in dose: 2 mg. once a day, for the first 10 days 3 mg. once a day, for the next 20 days 4 mg. once a day, thereafter Change in dose and drug: 2 mg. drug A each morning for a week 2 mg. drug B each evening for a week 3 mg. drug A thereafter 2. Discussion of the Related Art The increasing number of drugs manufactured as well as the increasing complexity of medication regimens combined with the growing elderly population, have created an urgent need for a simple, inexpensive, and fool-proof device to help users comply with their medication regimen (i.e., "compliance"). Current indicating closures remind users when to take their medication, for a single medication. The present invention is used with indicating closures for more than one medication (i.e., drug A-drug B or dose A-dose B). Whereas the VIRTUAL HINGE™ invention (U.S. Pat. Nos. 5,297,687 & 5,520,296 & Application Ser. No. 08/417,935) aids compliance by reminding users when to take their medication (i.e., once a day, twice a day, etc.), the present invention further aids compliance by also insuring that the correct medication is taken at the indicated time.

Many drugs, due to their potency, need to be increased (or decreased) gradually over time, to enable the patient to become accustomed to (or weaned off) the drug (i.e., "titrated"). Some drugs must be taken at different times (i.e., drug A every morning and drug B every night). This could be due to drug interactions, or the fact that they must be taken with food, or on an empty stomach, etc. The present invention relieves the user of making decisions (and possible errors) when she takes her medication, because only a given medication is accessible at a given time. This invention is preferably used with an indicating closure such as the VIRTUAL HINGE™ to create a complete compliance package. A package which insures that the right drug and dose is taken at the right time.

Numerous arrangements of the present invention enable the medication to be placed within the container in a manner which insures that the user access the proper medication for period indicated by the closure.

SUMMARY OF THE INVENTION

Current compliance packaging is usually in "unit dose" form (i.e., blisters containing a pill or pills to be taken together). The pill(s) are individually wrapped in blisters, between layers of cardboard, containing printed instructions on the cardboard as to which pill(s) to take and when. Dial Packs, frequently used for birth control pills, are another form of "unit dose" packaging. "Unit dose" packaging has numerous disadvantages for both the user and the manufacturer.

The disadvantages of "unit dose" packaging for compliance are, for example, that they are:

1) expensive (pills are individually packaged in printed cardboard, or plastic packs);
2) not customizable (i.e., must be pre-configured when manufactured);
3) difficult to open, each blister must be opened individually; and
4) error prone (the user may open the wrong blister).

The corresponding benefits of the present invention over "unit dose" packaging for compliance are, for example, that they are:

1) inexpensive;
2) easily customizable (by manufacturer or pharmacist);
3) easy to open; and
4) reliable and fool-proof.

An object of the present invention is to relieve the user of keeping track of which dose or drug to take. This invention provides a reliable and fool-proof method for taking medication. When the user opens the indicating closure at the indicated time, only the correct dose or drug is accessible.

Another object is that the invention be inexpensive, easy to use, easy to understand, and increase user compliance with periodic changes to drug and/or dose.

Another object is that it be quick and easy to manufacture, assemble, and mold.

Another object of this invention is that it be usable with an indicating (i.e., compliance or reminder) closure such as the VIRTUAL HINGE™ Closure, and thus acquire its' benefits, i.e., child resistance, can be opened with one hand, attached lid, etc.

Another object of the present invention is that prepackaged prescriptions, (i.e., "unit of use") be easily fillable on automated filling lines.

A further object of the present invention is that it be easily customized on an ad hoc basis by the pharmacist or user.

Another object of this invention is that it be quickly and inexpensively customized for complex medication regimens such as those used in clinical trial studies.

BRIEF DESCRIPTION OF THE DRAWINGS

The above and still further objects, features and advantages of the present invention will become apparent upon consideration of the following detailed description of a specific embodiments thereof, especially when taken in conjunction with the accompanying drawings, wherein like reference numerals in the various figures are utilized to designate like components, and wherein.

DETAILED DESCRIPTION OF THE PRESENTLY PREFERRED EXEMPLARY EMBODIMENTS

Referring to FIGS. 1–4B, the present invention is illustrated being used with the VIRTUAL HINGE™ closure having an indicating lid. FIGS. 1–4B achieve titration (increase/decrease in dose) by dividing the container into separate compartments.

Figures 1, 2A, 2B, 2C, 2D, 2E, 3A, 3B, 4A, 4B:
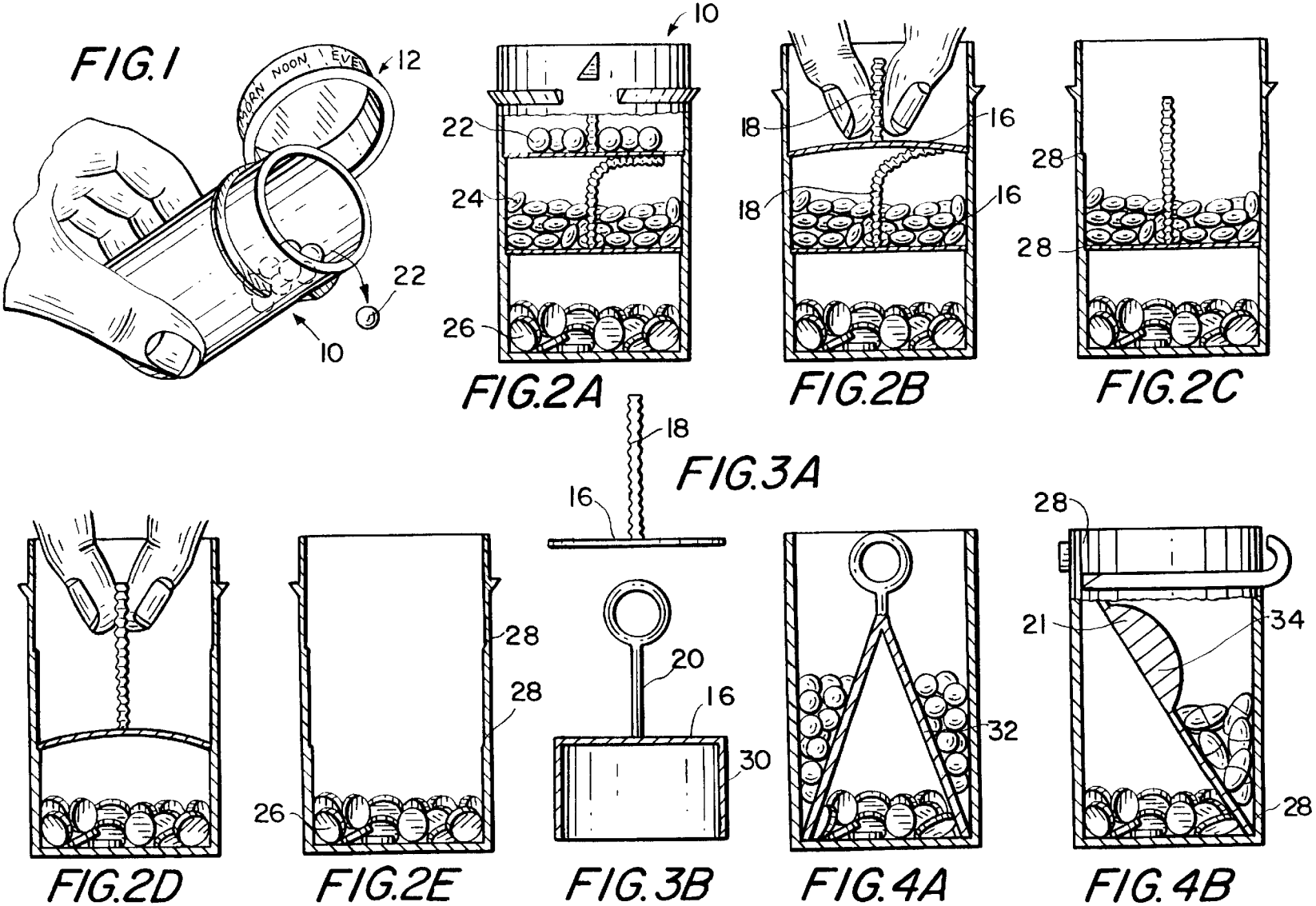
FIG. 1 shows an isometric view of a closure having an indicating lid indicating three times a day.
FIG. 2A shows a cross-section of the device of FIG. 1 with three different compartments for three different doses.
FIG. 2B shows a cross-section of the device of FIG. 1 after all the pills of the first dosage have been taken and the user is removing the horizontally oriented divider by the ridged stem.
FIG. 2C shows a cross-section of the device of FIG. 1 after the top divider has been removed.
FIG. 2D shows a cross-section of the device of FIG. 1 after all the pills of the second dosage have been taken, and the user is removing the second divider by the ridged stem.
FIG. 2E shows a cross-section of the device of FIG. 1 after the second divider has been removed.
FIG. 3A shows a cross-section of the divider and the ridged stem.
FIG. 3B shows a cross-section of an alternative divider having a skirt and loop at the end of the stem.
FIG. 4A shows a cross-section of a device having a cone shaped divider.
FIG. 4B shows a cross-section of a device having a diagonally oriented divider and a perpendicular handle.

FIG. 1 illustrates an indicating lid closure for 3 doses per day. FIGS. 2A–2E illustrates a container with three weeks worth of medication. The top compartment of the container in FIG. 2A has, for example, 21 pills of 1 mg each. Each time the user opens the lid (MORN, NOON, EVE) a 1 mg. pill 22 is available for a total of seven days. The other pills (different dose or drug) 24, 26 disposed in the container 10 are not yet accessible to the user. When there are no more pills in the top compartment (see FIG. 2B), the user removes the divider 16 by pulling up on the ridged stem 18, and the next set of higher (or lower) dose of pills 24 can be taken each time the user opens the closure (MORN, NOON, EVE). After the user has taken all these pills 24, she removes the next divider 16, to expose the last weeks set of pills 26, which are a different drug or dose than the prior week. The user continues to take pills 26 three times a day until there are no more left.

The user was never required to decide which pill to take (as with blister packs) because only the pills which should be taken were accessible to her (i.e., fool-proof). A stem 18, attached to the divider 16, helps the user remove the divider when the compartment is empty. This is simple, intuitive, and fool-proof. Grooves 28 may be molded into the container to firmly hold the dividers which may be forcibly wedged or snapped in and forcibly pulled out by the user. Divider 16 can be received in grooves in the internal sidewalls of container 10 or may be frangibly connected to the side walls of container 10. Alternatively, the divider can be connected to the container with a friction fit (See FIG. 3B). A skirt 30 downwardly depends from the divider simplifying insertion of the divider assembly into the container. A stem projects upwardly from divider 16 and has a loop 20 to thereby facilitate removal. FIG. 4A shows a cone shaped divider 32 having a loop on top. FIG. 4B shows a diagonally oriented divider 34 which could be glued in or wedged or snapped into grooves 28 in the container. A perpendicular handle 21 may be grasped for removal. Of course, many other combinations and variously shaped dividers and removal devices can be contrived to separate the pills and remove the dividers and the dividers could be snapped, glued, taped or molded in, etc.

When filling the container 10 with, for example, an automatic filling device, the process is reversed. These containers can be easily, quickly, and inexpensively filled on an assembly line with different drugs and/or doses and dividers for any number of titration changes.

Figure 7:
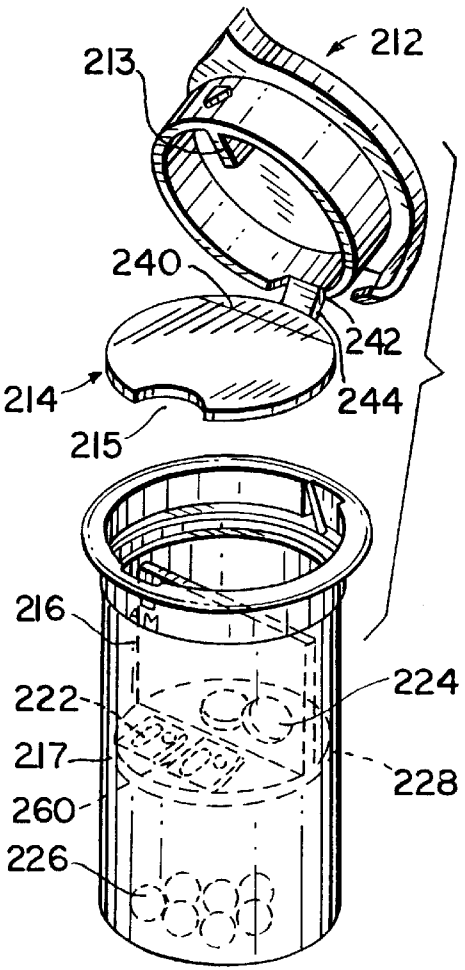
FIG. 7 shows a closure having an indicating container, with a pill cover attached to the lid as a one piece assembly, and having a removable divider that has both vertical and horizontal parts.
Figure 6A:
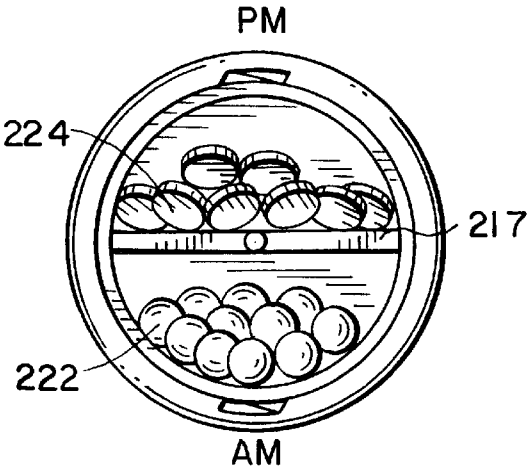
FIG. 6A shows a top view of FIG. 5 with two compartments. i.e., AM and PM.
Figure 6B:
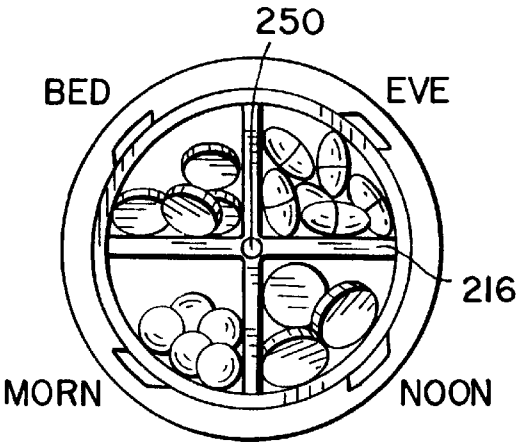
FIG. 6B shows a top view of FIG. 5 having four compartments, i.e. MORN, NOON, EVE, BED.
Figure 5:
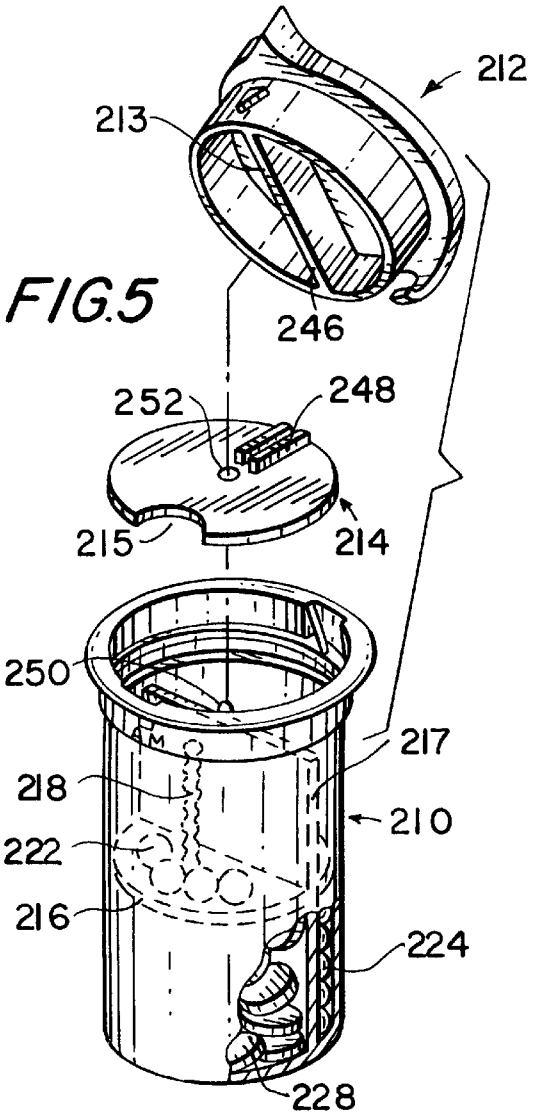
FIG. 5 shows a perspective view of the VIRTUAL HINGE™ closure having indicating container indicating two times per day and having a vertical divider and a pill cover.

Referring now to FIGS. 5–7, the present invention is illustrated being used with the VIRTUAL HINGE™ closure having an indicating container for periodically changing drug and/or dose. The container opens twice a day (AM and PM). The three different sets of pills are separated by a removable horizontal divider 216, and a vertical divider 217 (which could be integral with the container). A cover 214 has a hole 252 which snaps over a protrusion 250 on top of the divider 217. A ledge 246 on the cap engages with a groove 248 on cover 214 when the lid is closed so that the cover 214 rotates with the lid 212 forcing the opening 215 to move to the next compartment. The opening 215 in the cover 214 permits only those pills in the compartment underneath to be accessible when the lid is opened. Part of the ledge 213 covers the opening 215 when the container is closed to prevent pills from falling out. When the user opens the closure at the AM indicator, only the AM drug 222 in the top AM compartment is accessible. When the user next opens the closure at the PM indicator, only the PM drug 224 can fall out. When the top AM compartment is empty, the user removes the semi-circular divider 216, by pulling on the ridged stem 218, to expose a different medication 226, which is then taken every AM. FIG. 6B shows this container having 4 compartments for different drugs/doses taken each of (MORN, NOON, EVE, BED).

FIG. 7 shows a cover 214 integrally attached to the lid 212 by a living hinge 242. Another living hinge 240, rigid corner 244, and living hinge 242, cooperate so that the cover 214, rotates with the lid, when the lid is closed. Cover 214 remains wedged in the container when the lid is opened. This cover requires no assembly, is integral with the lid 212, and is easy to mold. Since the container in FIG. 7 indicates AM & PM, the user takes the two pills 222 in the pouch 260 every AM and pill 224 in the other compartment every PM. When these are finished, the user removes the divider 216 (consisting of a vertical and horizontal member) to expose the remaining pills 226 in the bottom compartment which then continue to be taken each AM and PM.

The present invention makes it possible to create a fool-proof compliance closure for a variety of complex medication regimens. Those regimens presented here represent only a small, non-limiting example of the virtually infinite number of possible regimens. In each case the user simply opens the closure at the indicated time and takes the accessible pill (or pills in the pouch). When there are no more pills (or pouches), she simply removes the divider to access the next drug and/or dose. This is a simple, intuitive, and fool-proof method of compliance. Of course, the medication could be pills, capsules, caplets or any combination of pills in pouches 260 to be taken simultaneously. Additionally, it is not necessary that the pills be part of a single medication regimen (i.e., the user could be taking Multivitamins every AM, blood pressure pills every PM, etc.).

Indicating closures may either have indicators (i.e., markers or indicia, such as MON, TUE, WED . . . or MORN, NOON, EVE) on the lid or on the container. The closures having indicators on the lid have different innate properties than the closures having indicators of the container. One embodiment of the VIRTUAL HINGE™ closure has the indicators on the lid, another embodiment has the indicators on the container. Although the present invention is shown used with VIRTUAL HINGE™ closures, it could be used with other closures having either indicating lids or indicating containers.

Although this invention has been described generally and in terms of the presently preferred embodiments, these should not be construed as limiting the scope of the invention i.e., there can be any number of compartments, the dividers and removal devices may have different shapes, or orientations, or made of different materials, inserted in a variety of ways, or the body of the container could be square, etc. Thus, the scope of this invention should be determined by the appended claims and their legal equivalents, rather than only the examples given.

What is claimed is:

1. A closure, comprising:

(a) a container having a top, said container having an opening only at said top;

(b) a lid, said lid having a closed and an opened position, wherein in said closed position, said lid covers said top and is rotatable with respect to said top, and in said opened position said lid is spaced apart from said top;

(c) a plurality of indicators disposed on one of said lid and said container; and said container;

(d) a pointer disposed on the other one of said lid and said container, said pointer selectively indicating to the user when to next open said lid and take medication;

(e) multiple units of medication; and (f) a divider adapted to be removed from said container, said divider being disposed in said container, said divider separating said container into at least two compartments, each of said at least two compartments containing said multiple units of medication, wherein said multiple units of medication contained in the first of said at least two compartments differ from said multiple units of medication contained in the second of said at least two compartments;

the container and divider being formed such that said multiple units of medication in one of said at least two compartments cannot be accessed from said top opening except after removal of said divider from said container.

2. A closure according to claim 1, wherein said removable divider is horizontally oriented in said container.

3. A closure according to claim 2, further including a skirt on said removable divider.

4. A closure according to claim 1, wherein said removable divider is substantially cone shaped.

5. A closure according to claim 1, wherein said removable divider is angularly oriented in said container.

6. A closure according to claim 1, wherein a portion of said removable divider is vertically oriented in said container.

7. A closure according to claim 1, wherein said container includes a groove for releasably holding said removable divider.

8. A closure according to claim 1, further including means for removing said removable divider from said container.

9. A closure according to claim 8, wherein said means for removing said removable divider includes a ridged stem.

10. A closure according to claim 8, wherein said means for removing said removable divider includes a loop.

11. A closure according to claim 8, wherein said means for removing said removable divider includes a handle.

12. A closure according to claim 1, further including a cover.

13. A closure according to claim 12, wherein said cover prevents removal of said multiple units of medication from said one of said at least two compartments.

14. A closure according to claim 13, wherein said cover is removable.

15. A closure according to claim 14, wherein said cover is engageable with said lid and said container.

16. A closure according to claim 12, wherein said cover and said lid are rotatable with respect to said container.

17. A closure according to claim 16, wherein said cover is integrally attached to said lid.

18. A closure according to claim 1, further including a divider integral with said container.

19. A closure according to claim 1, wherein said removable divider is frangibly attached to said container.

20. A closure according to claim 1, wherein said removable divider is adhesively attached to said container.

21. A closure according to claim 1, wherein said divider is wedged into said container by friction fit.

* * * * *